United States Patent [19]

Bertrand

[11] Patent Number: 4,912,891

[45] Date of Patent: Apr. 3, 1990

[54] FOLDING BUILDING STRUCTURE

[76] Inventor: Fernand Bertrand, 12 Pennington Lane, Gloucester, Ontario, Canada, K1B 4X7

[21] Appl. No.: 302,954

[22] Filed: Jan. 30, 1989

[30] Foreign Application Priority Data

Mar. 17, 1988 [CA] Canada ..... 561749

[51] Int. Cl.[4] ..... E04B 1/346

[52] U.S. Cl. ..... 52/66; 52/71; 52/721

[58] Field of Search ..... 52/69, 71, 64, 68, 66

[56] References Cited

U.S. PATENT DOCUMENTS

| | | | |
|---|---|---|---|
| 3,172,740 | 3/1965 | Elstner | 52/66 X |
| 4,045,926 | 9/1977 | Gibbs | 52/66 |
| 4,057,284 | 11/1977 | Blank | 52/66 |
| 4,171,843 | 10/1979 | Steury | 52/66 X |
| 4,633,626 | 1/1987 | Freeman et al. | 52/71 |
| 4,635,412 | 1/1987 | Le Poittevin | 52/79.5 |
| 4,660,332 | 4/1987 | Colvin, Jr. | 52/71 X |
| 4,780,996 | 11/1988 | Julien, Jr. | 52/69 X |

*Primary Examiner*—Carl D. Friedman

*Attorney, Agent, or Firm*—James D. Hall; Thomas J. Dodd; Todd A. Dawson

[57] ABSTRACT

A refoldable and transportable rigid building which requires no load bearing interior walls and further permits the permanent placement of plumbing and plumbing fixtures almost anywhere within the periphery of the exterior walls. Upon unfolding, the structural components of the building become fast on one another providing a rigid building which is capable of resisting substantial racking and compression stresses without loss of integrity. Folding and unfolding of the building may be accomplished with the use of hand tools only. A sixty per cent volume reduction is achieved on folding and when folded the structure may be handled by a forklift and/or supported on a pair of dollies.

15 Claims, 9 Drawing Sheets

20
2
21
8
9
23
22
24
25
26
54
6
5
4
10
43
28
27
11
3
19
55
50
33
34
13

FOLDING BUILDING STRUCTURE

The present invention relates to a foldable, finished building structure which may be unfolded and refolded for repeated relocation without damaging either its interior or exterior finishes. This assures that the building may be occupied practically immediately upon placing it on stilts or some other suitable foundation.

BACKGROUND OF THE INVENTION/PRIOR ART

Foldable buildings are known and several designs have been patented. Among the Canadian Patents granted in this field are Nos. 430,557 issued October, 1945 to F. M. Smith; 438,110 issued November, 1946 to D. R. Arshart; 835,013 issued February, 1970 to Al Tatevossian; and 1,204,911 issued May, 1986 to R. Julien. Each of the above Patents teaches a building which requires longitudinal walls which run all or a substantial portion of the length of a narrow, rigid central section of the building to support the roof of the unfolded structure. In addition, permanent fixtures and utilities such as kitchen sinks, washrooms, laundry rooms, and other utilities which require the permanent placement of plumbing fixtures may only be installed within the narrow central section of these buildings, because the side floors adjacent the longitudinal support walls of the central section must be left clean to allow the exterior walls to be folded down onto them. This restricts the floor plans of these buildings to two long narrow living spaces, one on each side of the central core. Most foldable buildings also require bolts, hooks, visible hinges, or other unsightly fasteners to hold the unfolded parts of the building together. This not only creates a eyesore but also requires extensive work if the building is to be refolded and moved to a new location. Lastly, the methods described for unfolding these buildings do not take into account the weight of the components which must be handled or the rigidity of the structures involved. Therefore, a need exists for a versatile and easily refoldable building structure.

SUMMARY OF THE INVENTION

The present invention overcomes the shortcomings of the prior art by providing a foldable building which does not require an longitudinal interior walls for supporting the roof structure. The building of the present invention may be repeatedly unfolded for use and refolded for relocation without deterioration of its structural components or its interior or exterior finishes. The building of the invention comprises a substantially rigid central roof structure and a substantially rigid central floor structure in a vertically spaced apart relationship, side roof sections pivotally connected to the longitudinal edges of the central roof structure, exterior walls to support the unfolded side roof sections, side floor sections pivotally connected to the longitudinal edges of the central floor structure, and walls pivotally mounted to fold into the central structure of the building. The central roof structure is supported by an elongated, rigid roof truss which is of substantially the same length as the central roof structure. This roof truss is connected to the central floor structure by two pairs of elongated members which pass through the respective end walls of the building and through holes provided in the central floor structure. Each pair of members which support the central roof truss is interconnected under the floor by a beam which fits slidably within, but is not permanently attached to, the walls of a cavity formed by the floor joists and joist headers of the underside of the central floor structure. Thus, these two pairs of members maintain the central roof structure in a vertically displaceable but horizontally fixed relationship with the central floor structure, permitting the roof to be raised to provide folding clearance for the foldable parts of the building.

More particularly, the present invention comprises a building structure having foldable wall and roof parts, a core structure for supporting the foldable parts of said building structure and providing folding clearance for said parts, said core structure comprising:

a substantially rigid roof structure and a substantially rigid floor structure in vertical spaced apart relationship, said roof structure comprising an exterior roof surface and an interior ceiling surface said structure being supported by a roof truss means of substantially the same length as said roof structure, said roof truss means being supported by elongated support members which pass through said floor structure and are vertically movable but laterally constrained by said floor structure whereby said roof structure is supported in a vertically displaceable but horizontally fixed relationship to said floor structure

DESCRIPTION OF THE DRAWINGS

The preferred embodiment of the present invention will now be described by way of example only and with reference to the following drawings wherein:

FIG. 6 illustrates the process of unfolding the building structure of FIG. 1 wherein

FIG. 8A is a floor plan of a dwelling in accordance with the invention wherein;

FIG. 9A is a floor plan of an alternate dwelling according to the invention wherein;

DETAILED DESCRIPTION OF THE PREFERRED EMBODIMENT

Figure 1:
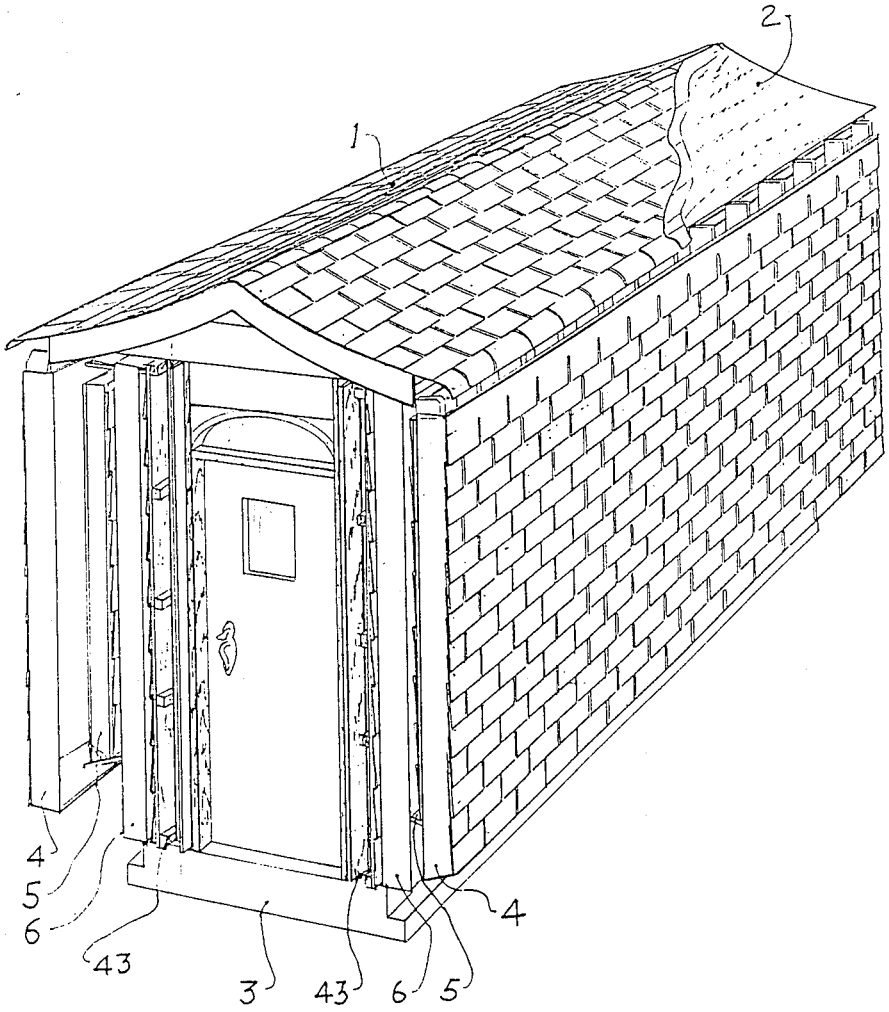
FIG. 1 is a perspective view of a folded building structure according to the invention.

Referring to the drawings. FIG. 1 shows a building structure of the present invention in a folded condition. The building comprises a central core generally referred to by the reference 1 which consists of a central roof structure 2 and a central floor structure (see FIG. 2). The central roof structure 2 supports side roofs 4 and side walls 5, while the central floor structure 3 supports side floors 6 and end walls 43 when the building is folded. The particulars of the attachment of these components is described in detail hereinafter.

Figure 2:
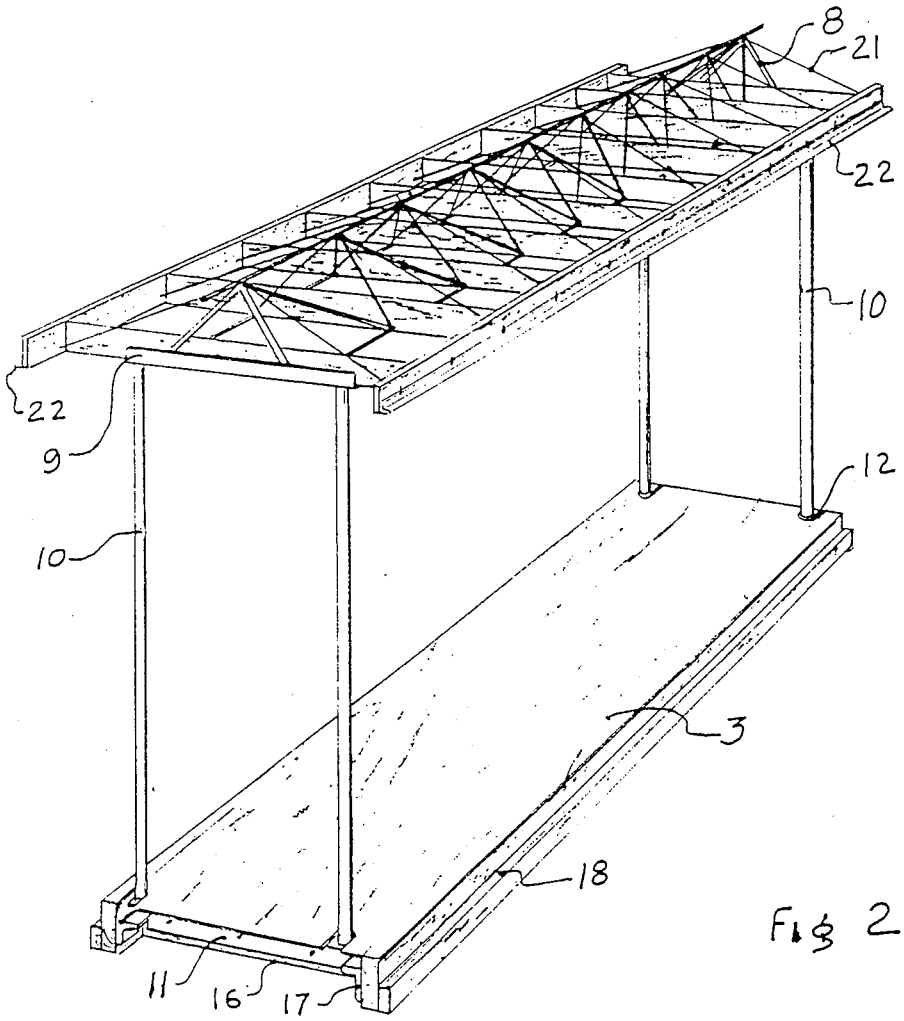
FIG. 2 is a perspective view of the support structure of the central core of the building shown in FIG. 1.
Figure 3A:
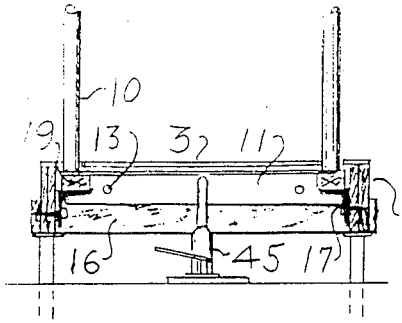
FIG. 3A is a schematic view of one end of the central floor structure shown in FIG. 2, with the beam which supports the central roof structure in its raised position to accommodate the folding of the building structure.
Figure 3B:
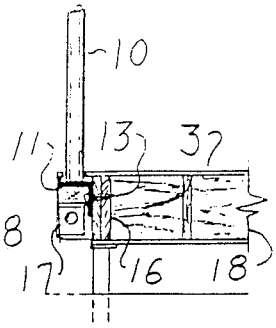
FIG. 3B is a cross sectional view of FIG. 3A.
Figure 3C:
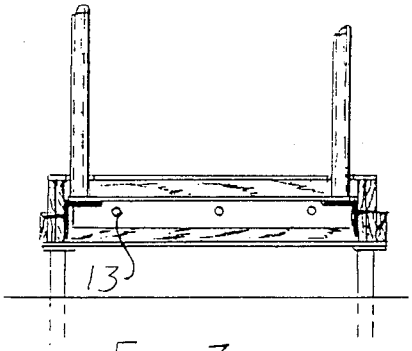
FIG. 3C is a schematic view of the structure shown in FIG. 3A, with the central roof support beam in its lowered position adapted when the building structure is unfolded.

The central core 1 of the building has a structural steel skeleton illustrated in FIG. 2 which supports the central roof structure 2. This structural steel skeleton comprises a central roof truss generally referred to by the reference 8, which is supported by a pair of tubular steel posts 10 at each end. Each pair of posts 10 is interconnected across the top ends by a angle iron 9 which is affixed to the ends of the bottom chords 14 of roof truss 8. Posts 10 pass through holes 12 in the central floor structure 3 and are interconnected under the floor by a angle iron 11 as illustrated in FIGS. 3A and 3C. Steel angle 11 is slidably confined between floor joists 16 and short angle irons 17 which are bolted to joist headers 18, permitting the central roof structure 2 to be raised and lowered by hydraulic jacks 45, or similar lifting devices (FIG. 3A). The vertical displacement of the central roof section 2 relative to the central floor section 3 plays an important role in the folding and unfolding of the building as will become apparent.

Figure 3D:
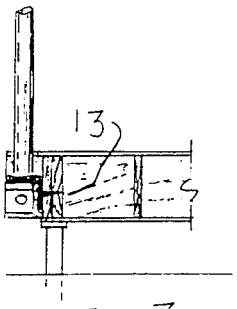
FIG. 3D is a cross sectional view of FIG. 3C.

FIG. 3A shows beam 11 in its raised position which is the required position for beam 11 during folding and unfolding of the building. Beam 11 is locked in the raised position by wooden blocks 19 and lag bolts 13 which engage floor joists 16 as shown in FIG. 3B. In FIG. 3C, beam 11 is shown in its lowered position, which is adopted when the building is in a folded or an unfolded condition. In the lowered position, beam 11 rests atop angle irons 17 and is affixed to floor joists 16 by lag bolts 13 (FIG. 3D). Lag bolts 13 lock the unfolded roof structure in place to assure that the central roof structure is not lifted by gale force winds.

Figure 4A:
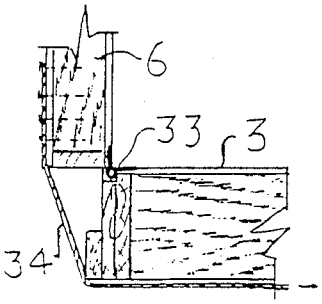
FIG. 4A illustrates a detail of the attachment of a side floor section to the central floor structure with the side floor in its raised or folded condition.
Figure 4B:
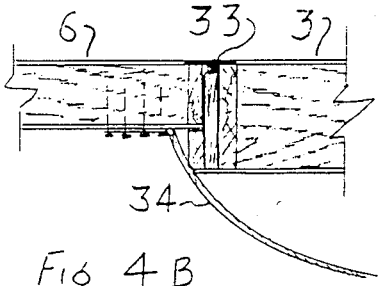
FIG. 4B is a detail of the attachment of a side floor section to the central floor structure with the side floor in its lowered or unfolded condition.

FIGS. 4A and 4B illustrate the connection of the side floor sections 6 to the central floor structure 3 by hinges 33. Hinges 33 are mortised barrel down and flush with the floor surfaces at regular intervals along the length of the joint between side floor 6 and central floor structure 3, however, they are not centered over the joint. Each hinge 33 is offset toward the central floor structure 3 side of the joint so that the barrel of each hinge 33 lies inward of and adjacent the edge of the central floor structure 3. Hinges 33 are installed in this specific fashion for three reasons. Firstly, it permits the installation of a continuous vapor barrier (not illustrated) under the entire floor surface. Secondly, it yields a minimum gap between the side floors 6 and central floor 3 In their unfolded condition. Lastly, as seen in FIG. 4A. when the side floor section 6 is pivoted to its folded position the edges of the side floor surface bears continuously along an edge of the surface of the central floor structure 3. Thus, this position of hinges 33 provide a distributed bearing of the edges of the floor surfaces of side floor sections 6 on the central floor surfaces over composite beams 18 of the central floor structure 3. The bearing of the side floor surfaces on the central floor surface acts in conjunction with synthetic cloth straps 34 to lend rigidity to the folded building structure. Straps 34 are at disposed regular intervals along the length of side floor sections 6. Each of the straps 34 passes under the central floor structure 3 and is attached by each end to the opposing side floor sections 6 as illustrated in FIGS. 4A and 4B. All of the straps 34 are equal in length and affixed to the side floors 6 so as to be under tension when the side floors are in a folded condition. This effectively transforms side floors 6 into longitudinal box beams which support the central core structure 1 when the building is in a folded condition, permitting the folded building to be picked up at mid span by a fork lift or end supported on dollies without affecting the integrity of the building structure or damaging any of its components.

Figure 5:
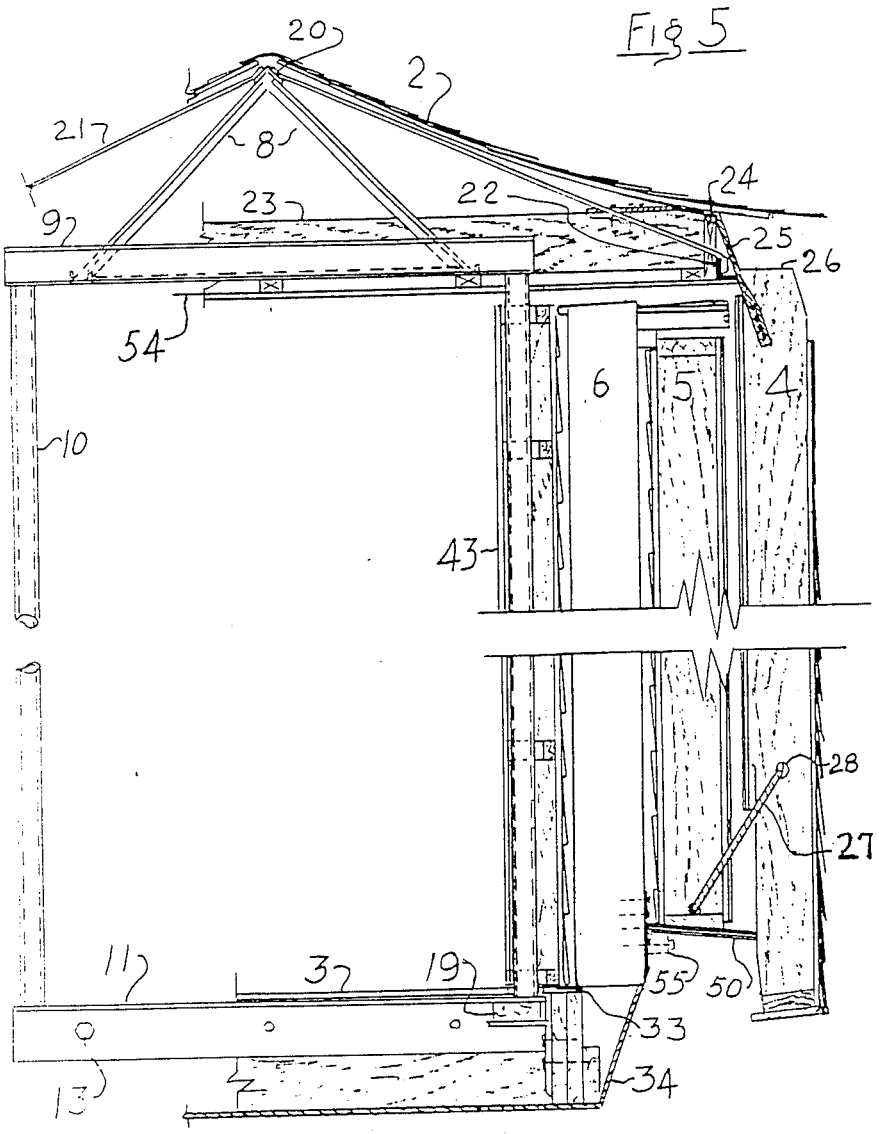
FIG. 5 is a cross sectional detail of a portion of the central roof structure, a side roof section and a side wall section with the side roof and side wall in their folded conditions, showing the details of the attachments of the side roof to the central roof structure and the side wall to the side roof.

FIG. 5 shows in detail a portion of the cross sectionally symmetrical central roof and floor structures 2 and 3, a side roof 4, a side wall 5, a side floor 6 and an end wall 43 in a folded condition. Side roof section 4 is suspended from the upper surface of the central roof structure ceiling joists 23 by straps 25. Straps 25 are preferably made of nylon webbing or some similarly strong synthetic fabric. Straps 25 retain side roof rafters 26 against a angle iron 22 which is attached along the length of ceiling joist header 24. This protects the ceiling membrane 54 of the central roof structure 2 from the crushing forces of the ends of side roof rafters 26. Steel angle 22 is affixed at regular intervals to the top chord 20 of roof truss 8 by structural steel rods 21. The side wall section 5 is suspended in an upside down orientation from side roof section 4 when in a folded condition. The connection between side roof 4 and side wall 5 comprises lengths of synthetic rope 27 or a flexible cable. Rope 27 passes through holes 28 in side roof rafters 26 and side wall studs 29 and is affixed thereto on each end by knots or appropriate connectors. The placement of holes 28, in conjunction with a wide tongue 50 which runs the length of the top of the side wall section 5, serves to create a balanced force which maintains a gap between the ceiling surfaces 30 of the side roofs 4 and the interior surfaces 31 of the side walls 5. Although ropes 27 support the side wall 5 during folding and unfolding, a longitudinal support 55 attached to the lower outside surface of side floor 6 bears the weight of the side wall 5 during storage and transport.

Figure 6A:
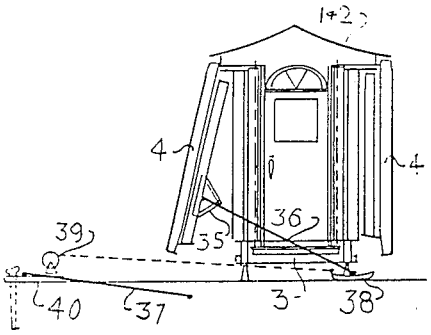
FIG. 6A, 6B and 6E illustrate the process as seen from the front of the building
Figure 6B:
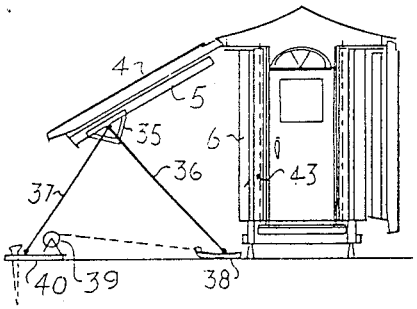

The process of unfolding the building structure will now be explained with reference to FIG. 6. Unfolding is begun by pushing side wall 5 and side roof 4 slightly way from side floor 6 as shown in FIG. 6A. This is easily accomplished by hand as the force required to rotate these sections a short distance from the vertical is not great. A prop, not illustrated, holds the side roof 4 and side wall 5 away from side floor 6 until a light truss 35 can be attached to the ends of side wall 5 in the position illustrated. Truss 35 struts 36 and 37, shoes 38, winch 39 and pulley 41 are specialized hand tools provided as auxiliary pieces of equipment for folding and unfolding the building. Truss 35, preferably constructed of light weight aluminum tubing for easy handling, is triangular in cross section and slightly longer than the building structure. The ends of the chords of truss 35 converge and terminate in trunions formed to accept steel struts 36 and 37.

Figure 6C:
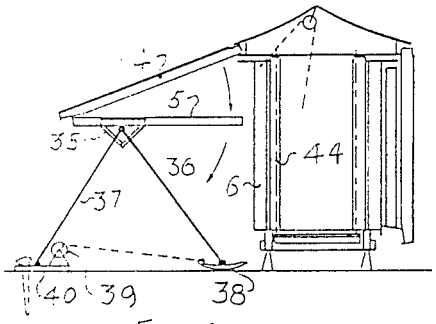
FIG. 6C, 6D and 6F illustrate the process as seen from the rear of the building.
Figure 6D:
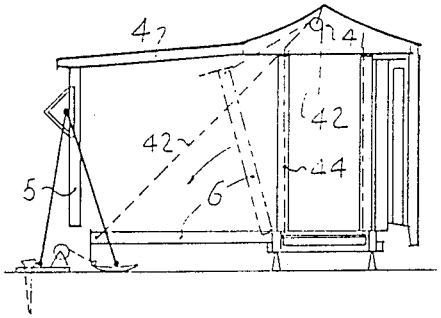
Figure 6E:
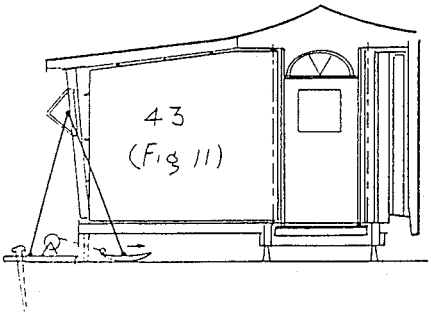
Figure 6F:
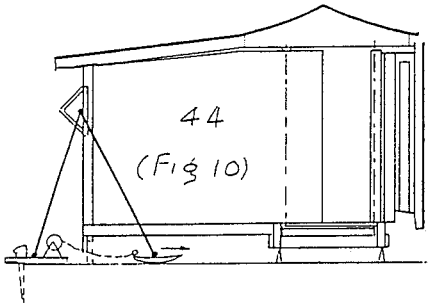

Referring again to FIG. 6A, struts 36 are inserted into the trunions on each end of truss 35 and seated into pivots in shoes 38. Shoes 38 are connected to the cables of hand winches 39 which are staked to the ground by stakes 40. The cables of hand winches 39 are rewound to rotate side wall 5 and side roof 4 into the position illustrated in FIG. 6B. Although only one hand winch and one set of struts 36 and 37 are illustrated for clarity, there is an identical set of equipment operated in the same manner at the opposite end of the building. When side roof 4 and side wall 5 have been rotated into the position illustrated in FIG. 6B, the second pair of struts 37 are inserted into the trunions of truss 35 and placed in pivot points on the base of hand winch 39. Struts 37 resist the outward thrust of the side roof and side wall 5, thereby reducing the strain on cloth straps 25 which connect the side roof 4 to the central roof structure 2 (see FIG. 5). From the position of FIG. 6B, the bottom of side wall 5 is rotated downward and outward as illustrated in FIG. 6C to the position shown in FIG. 6D. This rotation of sidewall 5 may also be accomplished by hand as the position of truss 35 and the weight of side wall 5 affords considerable mechanical advantage. Side floor 6 is lowered to its unfolded condition by ropes 42 which are strung about pullies 41 attached to the ends of the top chord 20 of the central roof truss 8 (see FIG. 2). End wall 43, on the entrance end of the building, and end wall 44 on the opposite end of the building are rotated into their unfolded condition, illustrated in FIGS. 6E and 6F respectively, after side floor 6 is lowered to its unfolded condition. As previously explained, the central roof section 2 is maintained in the raised position while folding and unfolding the building structure. This provides clearance between the floor and ceiling surfaces for pivoting the end walls 43 and 44 from their folded to their unfolded positions. End walls 43 and 44 rotate about the posts 10 which support the central roof structure 2 (FIG. 2). As can be seen in FIGS. 10A, 10B, 11A and 11B, end walls 43 and 44 may be removed from posts 10 during folding if required by the placement of permanent plumbing fixtures on the side floors, as will be explained hereinafter in detail. End walls 43 and 44 re provided with stub dowels which project at regular intervals from the sloped portions of their tops, plates and the outside ends of the walls. These stub dowels 71 engage complementary holes in the edges of side roof 4 and side wall 5 (FIG. 6E) to retain the end walls in their unfolded condition. Similar stub dowels 71 also project from the edges of side floor 6 to engage complementary holes in the bottom plates of end walls 43 and 44, further reinforcing the retention of the end walls in their unfolded condition. After end walls 43 and 44 are unfolded, any inside partitions in the corresponding half of the building are unfolded.

The construction and unfolding of interior partitions will be explained in reference to FIGS. 8 and 9. Once all of the above mentioned foldable walls and partitions are in their unfolded positions, hand winches 39 are reversed to permit side roof 4 and side wall 5 to descend and engage dowels 71. Side wail 5 is then pushed inward along its top edge by strut 37 to complete the unfolding of one side of the building. The process is then repeated in the same sequence on the opposing side of the structure. When both sides of the building are unfolded, the central roof structure is lowered using jacks 14 (see FIG. 3A), and beam 11 is locked in the lowered or unfolded position with lag bolts 13 as shown in FIG. 3C and 3D.

Figure 7:
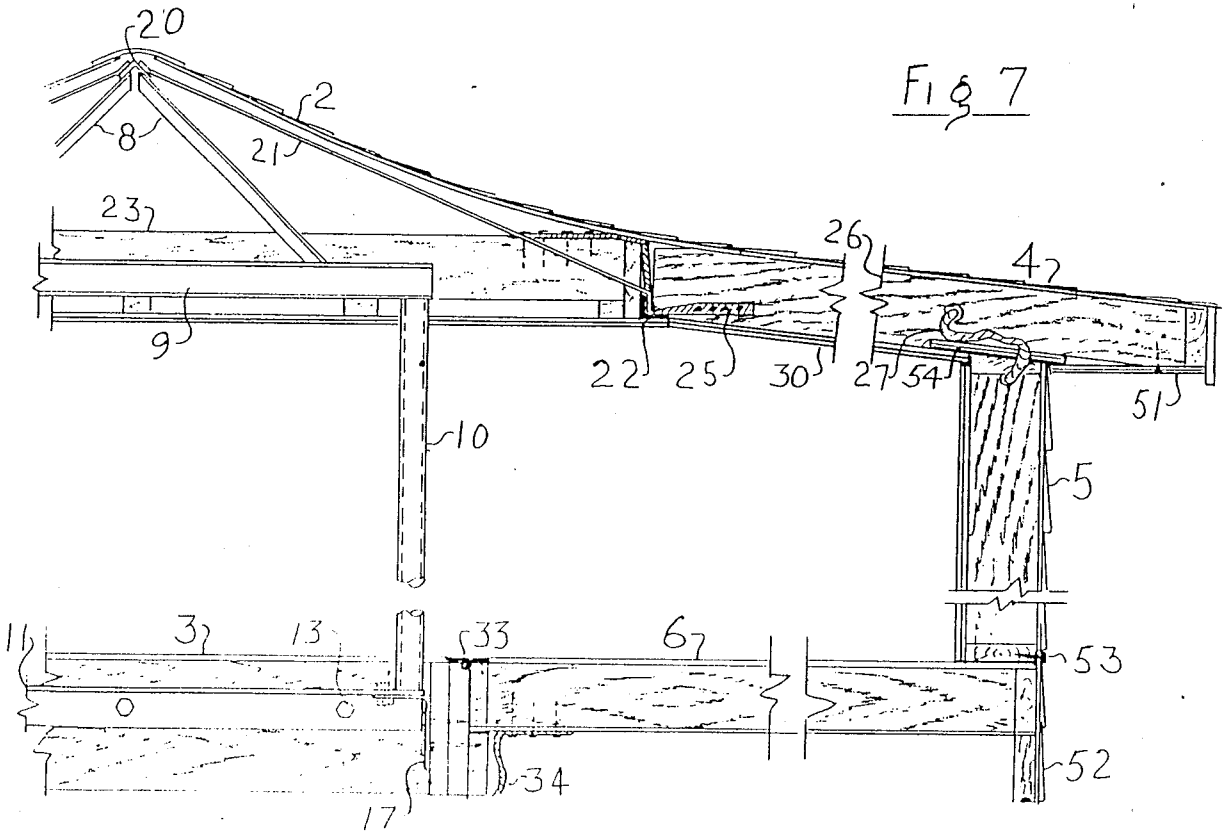
FIG. 7 is a cross sectional detail of a portion of the central roof structure, a side roof section, a side wall section and a side floor section showing the details of the attachments of the side wall to the side roof and the side wall to the side floor in the unfolded condition.

FIG. 7 illustrates side roof 4 and side wall 5 in an unfolded condition. Side roof rafters 26 are guided onto angle iron 22 by straps 25 during the unfolding process. The weight of one half of the side roof 4 plus the weight of subsequent snow loads on side roof 4 create considerable deflection forces on angle icon 22 and ceiling joists 23. These deflection forces are, however, transferred to the top chord 20 of the central roof truss 8 by steel rods 21. The triangulation of steel rods 21 and ceiling joists 23, in conjunction with the roof truss 8 which is supported on its ends by steel posts 10, provides a roof support structure which is capable of supporting considerable dead weight, even though the weight is poorly distributed as a result of the uneven drifting of snow across the double pitched roof.

The side wall 5 is secured along its top edge to side roof 4 by a wide tongue 50 which engages a slot 54 in the side roof rafters 26. Slot 54 extends under the ceiling surfaces 30 of the side roof 4, providing a locking engagement for tongue 50. After tongue 50 is engaged in slot 54, a soffit board 51 is fastened to the outer ends of side roof rafters 26, closing the eaves of the building and locking tongue 50 in slot 54. The bottom of side wall 5 is secured to side floor 6 by screws 53 which are driven through a side floor stiffener board 52 and into the bottom plate of side wall 5. Board 52 extends the full length of the side floor 6 and is permanently attached thereto to prevent sagging of the side floor 6 during folding and unfolding as well as providing an attachment for the bottom of side wall 5.

Figure 8A:
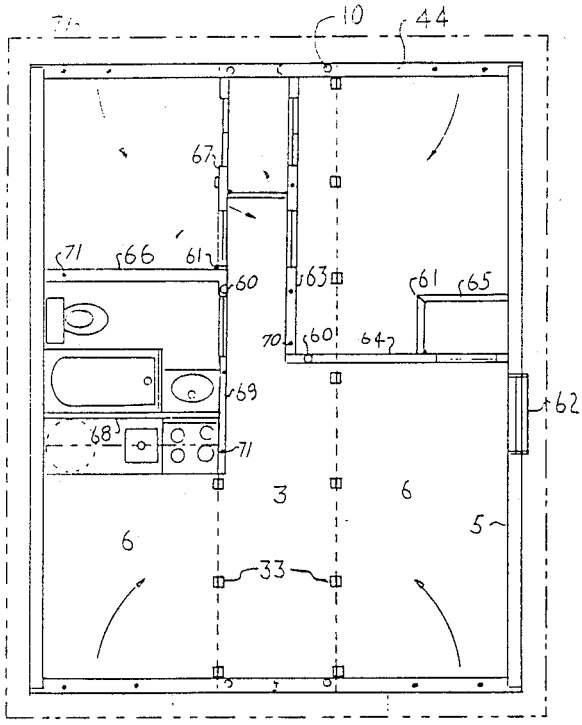

FIG. 8A illustrates a potential floor plan for a dwelling according to the invention. As may be noted, an entrance door 62 is located in the side wall 5 on the right of the floor plan in FIG. 8A. The bathroom and kitchen facilities are located on side floor 6 on the left side of the building. This arrangement is practical since there are no longitudinal support walls along the edges of central floor section 3 to obstruct these permanent fixtures from pivoting into the central section when side floor 6 is pivoted upright into its folded condition. Various interior partitions are provided in this plan for the sake of room division only as they are not required to support the roof structure. Partition 63 in the central section is the only partition which is not foldable. Partition 63 is permanently attached along its bottom plate to the central floor 3, in the normal practice of construction. The top of partition 63 is secured by long dowels 70 which project from its top plate through complementary holes in the ceiling of the central roof structure 2. Dowels 70 are long enough that they do not disengage the ceiling of the central roof structure 2 when the central roof structure is raised to fold the building. The arrows on the floor plan in FIG. 8A indicate the direction of rotation of the foldable partitions. Closet partitions 65 fold on hinges 61 against partition 64 which rotates about pivot 60 into the central floor section 2. Partitions 67 and 68 also fold about hinges 61 to lie against partition 66 which likewise rotates about pivots 60 into the central floor section 2. Pivots 60 comprise lengths of tubular steel or aluminum which are engaged in complimentary holes in the top and bottom plates of the partitions 64 and 66. Pivot tubes 60 are long enough not to disengage the floor and ceiling when walls 64 and 66 are pivoted to their folded positions. Electrical wiring required for the pivotable partitions is run through pivots tubes 60 permitting the building to be wired according to local building codes while obviating the necessity of disconnecting electrical wiring on folding. All foldable partitions are secured along their top plates by stub dowels 71 which project from the top plates of the partitions and engage complimentary holes in the ceilings when the roof sections are lowered after the unfolding of the building is complete. The bottoms of the foldable partitions are secured to the floor by stub dowels which project from the floor and engage complimentary holes in the bottom plates of the foldable partitions, providing plane surfaces on the bottom plates of the partitions to prevent marring of the floor surfaces during folding and to provide even bearing of the folded partitions on the central floor during relocation of the building structure.

Figure 8C:
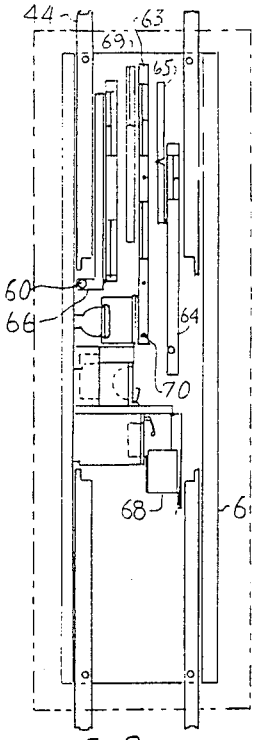
FIG. 8C is a plan view of the dwelling of FIG. 8A in a folded condition with the central roof structure and side roof sections not illustrated for clarity.
Figure 8B:
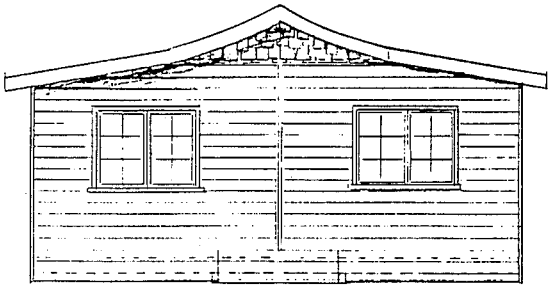
FIG. 8B is an end view of the dwelling of FIG. 8A.
Figure 8D:
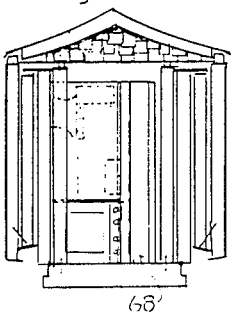
FIG. 8D is an end view of the dwelling of FIG. 8A in a folded condition.

FIGS. 8C and 8D show the dwelling of FIG. 8A and 8B in a folded condition. Elements superfluous to the illustration of the folded interior of the dwelling are not depicted for the sake of clarity. Note that partition 68 is hinged longitudinally to fold downward over the kitchen fixtures and that wall 69 is removed from its unfolded position and stacked between the other folded partitions in the rear of central floor structure 3, preventing interference of these walls with the right hand side floor 6 on folding that side of the building.

Figure 9A:
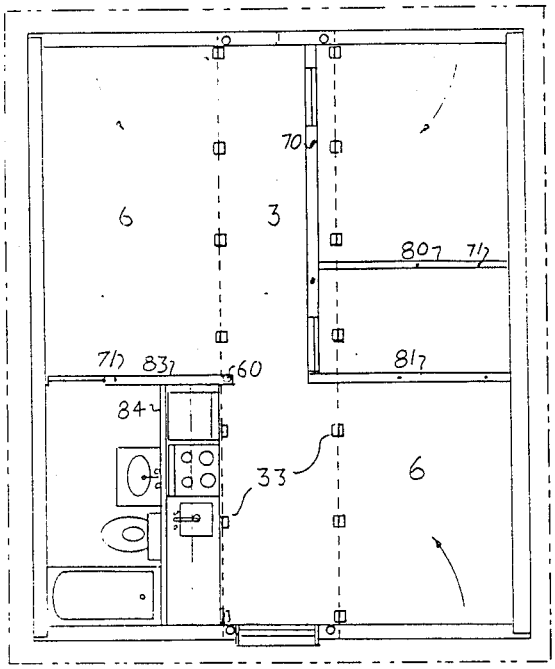
Figure 9C:
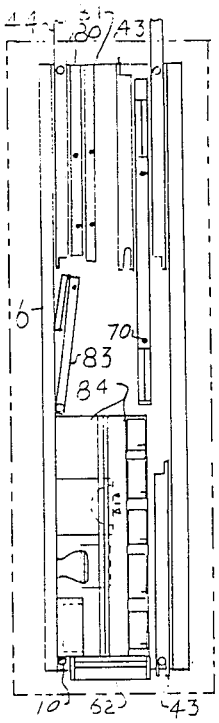
FIG. 9C is a plan view of the dwelling of FIG. 9A in a folded condition with the central roof structure, the side roof sections not illustrated for clarity.
Figure 9B:
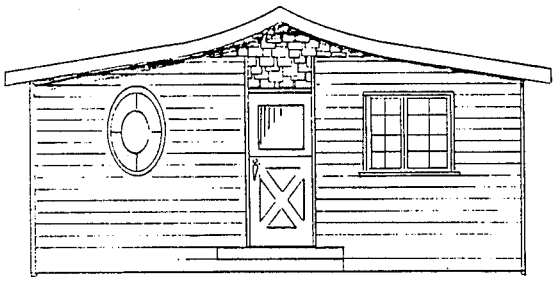
FIG. 9B is an end view of the dwelling of FIG. 9A.
Figure 9D:
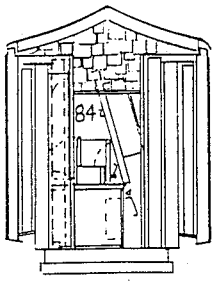
FIG. 9D is an end view of the dwelling of FIG. 9A in a folded condition.
Figure 10A:
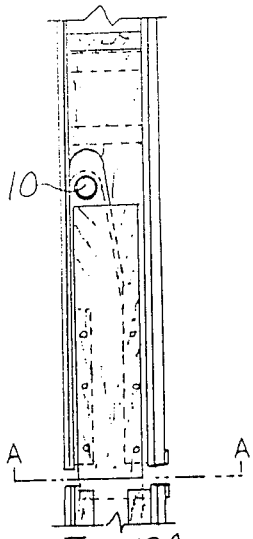
FIG. 10 shows a plan and an elevational view of the pivot mechanism of the end walls of a building according to the invention wherein the end of the building is not provided with an entrance door.
Figure 10B:
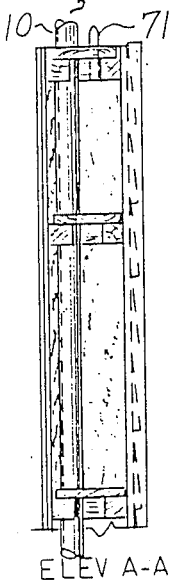
Figure 11A:
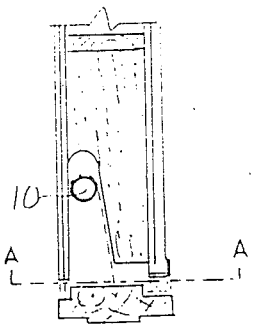
FIG. 11 shows a plan and elevational view of the pivot mechanism of the end walls of a building according to the invention wherein the end of the building is provided with an entrance door.
Figure 11B:
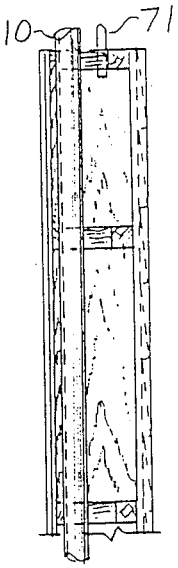

FIG. 9A shows an alternate floor plan for a dwelling according to the invention. In this floor plan, entrance door 62 is in one end of the dwelling. Only partition 83 is rotated about pivot tubes 60 when folding this dwelling. Partitions 80 and 81 are removed from their unfolded positions and stacked in the central section alongside partition 82 as seen in FIG. 9C. partition 84 is hinged longitudinally to fold downwards over the bathroom fixtures as seen in FIG. 9D. As may also be seen in FIG. 9C, end wall 43 on the left of entrance door 62 (see FIG. 9B), is removed from post 10 which supports the central roof structure (see FIG. 2), and stacked in the rear of the central structure to provide folding clearance for the bathroom and kitchen fixtures.

As is apparent from the foregoing descriptions, the present invention provides a versatile foldable structure which is readily adaptable to a variety of uses and floor plans. On folding the building structure of the invention, a 60% reduction of the unfolded volume is achieved, providing a foldable structure which is easily transported over most roads without expensive prearrangements.

I claim:

1. In a building structure having foldable wall and roof parts, a core stcuctuce for supporting the foldable parts of said building structure and providing folding clearance for said parts, said core structure comprising:

a substantially rigid roof structure and a substantially rigid floor structure in vertical spaced apart relationship, said roof structure comprising an exterior roof surface and an interior ceiling surface said structure being supported by a roof truss means of substantially the same length as said roof structure, said roof truss means being supported by elongated support members which pass through said floor structure and are vertically movable but laterally constrained by said floor structure whereby said roof structure is supported in a vertically displaceable but horizontally fixed relationship to said floor structure.

2. A foldable building structure comprising:

a substantially rigid central roof structure and a substantially rigid central floor structure in vertical spaced apart relationship, said central roof structure being supported by roof truss means of substantially the same length as said central roof structure, said roof truss means being interconnected with said central floor structure by elongated members which pass through but are not permanently affixed to said central floor structure so that said central roof structure is supported in a vertically displaceable but horizontally fixed relationship to said central floor structure;

side roof sections pivotally connected along longitudinal edges of said central roof structure, said side roof sections being movable from an unfolded position wherein they form a continuation of said central roof structure to a folded position wherein they are suspended vertically from the opposing edges of said central roof structure;

exterior support means for said side roof sections in their unfolded positions, said exterior support means being pivotally mounted at or adjacent the longitudinal edges of said side roof sections remote from said central roof structure and movable from a position wherein they are folded against said side roof sections to a position wherein they provide vertical support along the longitudinal edges of said side roof sections;

side floor sections pivotally connected to longitudinal edges of said central floor structure and movable from an unfolded position wherein they form a continuation of said central floor section to a folded position wherein they are vertically disposed along the longitudinal edges of said side floor section; and first and second end wall sections pivotally mounted about vertical axes to the respective support members of said central roof structure and rotatable from an unfolded position forming end walls for said building structure to a folded position parallel to the longitudinal edges of said central floor section.

3. A foldable building structure as in claim 2 wherein said roof truss means comprises an elongated, steel truss structure which is triangular in cross section, said roof truss being supported at each end by a pair of rigid metal posts which pass through passageways in said end wall sections and the end regions of said central floor structure of said building, the posts of each pair being interconnected at their lower ends by a beam which is slidably located within vertical guide means located at the ends of said central floor structure, said guide means further comprising means to prevent said beam from disengaging said guide means.

4. A building structure as in claim 2 or 3 wherein said side floor sections are connected to the central floor structure by hinges located barrel down and mortised flush with the respective floor surfaces said hinges being offset to one side of the joints between said side floor sections and said central floor structure so that the barrel of each said hinge is inward of and adjacent the longitudinal edge of said central floor structure.

5. A building structure as in claim 2 or 3 wherein straps are attached at regular intervals along the length of said side floor sections, said straps passing under said central floor structure and connecting said side floor sections together and disposed so as to be under tension when said side floor sections are in their folded condition.

6. A building structure as in claim 2 or 3 wherein said exterior support means comprise side walls which are attached to the side roof sections by lengths of rope or cable and fold inwardly and upwardly to a position parallel to said side roof sections, and wherein spacers are provided to prevent contact between the side roof and side wall surfaces.

7. A building structure as in claim 2 or 3 wherein the end wall sections are detachable from said roof truss support members.

8. A building structure as in claim 2 or 3 wherein said central roof structure comprises a ceiling joist header along each side of said structure and an angle iron is attached along the lower edge of said ceiling joist header on each side of the central roof structure and to said roof truss means at regular intervals by lengths of steel rod, each said length of steel rod being attached at its one end to said angle iron and at its opposite end to a top chord of said roof truss means.

9. A building structure as in claim 2 or 3 wherein a flexible joint is formed between the central roof structure and the side roof sections by means of cloth straps attached to ceiling joists of the central roof structure and to rafters of the side roof sections, said cloth straps guiding the ends of the rafters of each said side roof section to bear against an angle iron attached to a lower longitudinal edge of a ceiling joist header on an adjacent side of said central roof structure as the side roof sections are pivoted to their folded condition.

10. A foldable building structure as in claim 2 or 3 wherein said exterior support means comprise side walls, each having a tongue member affixed to the top of the side wall, said tongue members projecting beyond the tops of said side walls and providing a locking engagement between the side walls and respective side roof sections when each said tongue member is inserted into a slot provided between side roof rafters and a side roof ceiling membrane, said locking engagement being further reinforced by the application of a soffit board to the eaves of said building when the unfolding of said side wall is complete, said soffit board engaging the lower outside edge of each said tongue member to immobilize the top of said side wall.

11. A foldable building structure as in claim 2 or 3 wherein said exterior support means comprise side walls and a skirt attached along the outside edge of each side floor section prevents sagging of said edge of said side floor sections during folding and unfolding of said building structure, said skirts further projecting above the floor surfaces of said side floor sections to provide a means of securing the bottom of the side walls to said side floor sections when said building is in an unfolded condition.

12. A building structure as in claim 2 or 3 wherein the foldable walls and partitions of said building are retained in their unfolded condition by short dowels, pins or rods which project from the portions of their tops that contact the ceiling surfaces of the side wall sections to engage complementary holes in the side roof sections of said building, and by additional dowels, pins or rods which project from the side floor sections to engage complementary holes in the bottom of said foldable walls and partitions.

13. A building structure as in claims 2 or 3 wherein fixed partitions within the central structure of said building are fixably secured to said central floor structure along the bottoms of said partitions, their tops being secured by long dowels, rods or tubes which project from said top plates and engage complementary holes in the ceiling surface of said central roof structure, said dowels, rods or tubes being of sufficient length so as not to disengage said ceiling when the central roof structure is raised to fold or unfold said building structure.

14. A building structure as in claim 2 or 3 provided with rotatable interior partitions, each provided with a pair of vertically opposed tubular members forming pivots which project from the tops and bottoms of said partitions and pass through guide means in the floor and ceiling of said central sections, said tubular members being rotatably and slidably displaceable within said guide means, said tubular members being of sufficient length so as not to disengage said guide means when said central roof section is raised to fold or unfold said building structure.

15. A method of folding and unfolding the building of claims 1, 2 or 3, wherein a light, triangular, metal truss is trunion mounted to a pair of struts on each of its ends, said truss being positioned along the exterior surface of a side wall section in a position which is approximately three quarters of the height of said wall from its bottom edge, and attached to each end of said side wall in the position described so that the weight of said side wall assists in supporting the side roof section to which said side wall section is attached, throughout the length of its outside edge, permitting the building to be folded and unfolded using only the truss and struts described, a pair of hand winches or similar devices, and such other hand tools as required to drive screws or other fasteners, all operations of the folding or unfolding process taking place at or below the level of the eaves of said building.

* * * * *